United States Patent [19]

Liljeström et al.

[11] Patent Number: 4,831,951

[45] Date of Patent: May 23, 1989

[54] ICE-BREAKING VESSEL

[75] Inventors: Göran Liljeström, Västra Frölunda, Sweden; Bengt Johansson, Calgary, Canada

[73] Assignee: Gotaverken Arendal AB, Gothenburg, Sweden

[21] Appl. No.: 156,826

[22] Filed: Feb. 17, 1988

[30] Foreign Application Priority Data

Feb. 23, 1987 [SE] Sweden ..... 8700738

[51] Int. Cl.[4] ..... B63B 35/08

[52] U.S. Cl. ..... 114/41; 114/56

[58] Field of Search ..... 114/40–42, 114/56, 57, 63

[56] References Cited

U.S. PATENT DOCUMENTS 4,369,725 1/1983 Lord et al. ..... 114/40
4,715,305 12/1987 Wilkman et al. ..... 114/40

FOREIGN PATENT DOCUMENTS 1066139 11/1979 Canada .
85011955 3/1985 Sweden .
1551517 2/1978 United Kingdom .

OTHER PUBLICATIONS

"Svensk Sjofartstidning", No. 6–7 (Feb. 6, 1987).
"Svensk Sjofartstidning", No. 8 (Feb. 20, 1987).

*Primary Examiner*—Sherman D. Basinger
*Assistant Examiner*—Edwin L. Swinehart
*Attorney, Agent, or Firm*—Wegner & Bretschneider

[57] ABSTRACT

An ice-breaking vessel having a spoon-shaped bow portion and an obliquely downwardly/rearwardly extending reamer at each longitudinal side is provided with second reamers located above the water line, above the rear portion of the adjacent first reamer and extending further outward than the same. A plow-shaped extension projects downwards from the plane bottom of the vessel, and has a breadth less than the breadth thereof. The rearmost part of the deck of the aft portion of the vessel has a reduced breath, so two corners are formed at each side of the deck. The bilges at the bottom plating extend to the forward of these corners, while the bilges at the plow-formed extension extend to the rearward corners.

2 Claims, 3 Drawing Sheets

ICE-BREAKING VESSEL

BACKGROUND OF THE INVENTION

The responsibilities of an ice-breaker are manifold, but a major task is to open channels through ice-fields so merchant ships can pass along. Assisting merchant ships often means that the ice-breaker must be able to turn around within a limited space.

The hull of an ice-breaker shall be designed in such a manner, that broken-off floes are largely pushed out below the iceboundaries of the channel, and do not disturb the propellers and fill the opened channel. The power consumption of the vessel is of course an important point to consider.

There are ice-breakers having a bow portion provided with a downwardly-rearwardly extending enlargement at each longitudinal side, a so called reamer, which determine the effective breadth of the channel, which, due to the reamers will be wider than the breadth of the hull.

Ice-breakers of this type have shown very favourable operational performance, also during severe ice conditions.

It may, however, happen that the vessel will be caught in a wall of ice, and it may also be advantageous to perform narrow turns in connection to the opened channel.

SUMMARY OF THE INVENTION

An ice-breaking vessel having a mid-body defined by substantially vertical side walls, a plane bottom and a deck as well as a bow portion and an aft portion forming continuations thereof is characterized in that the bow portion has a mainly plane bottom raising from the bottom of the mid-body and lacking a marked stem line, as well as a first reamer at each side wall extending downwardly rearwardly about from said deck to below the waterline.

A second reamer at each side wall is located above the waterline in the region of the rear part of the first reamer at the same longitudinal side and designed with a breadth, which from a forward connection at said side wall increases rearwardly to exceed the breadth of the adjacent first reamer.

The vessel having transversely located trimming tanks and pumping means for the transfer of ballast water between the tanks with sufficient capacity to bring either of said second reamers into contact with the ice sheet at waterline level.

Each second reamer, in a plan-view preferably, shows a quarter-circular rear portion projecting from said side wall, as well as a forward portion extending like a wedge from said rear portion and merging into said side wall, the second reamer being sidewardly defined by an upper vertical face and a lower face tapering into said side wall.

In an ice-breaking vessel having a mid-body defined by substantially vertical side walls, a plane bottom and a deck as well as a bow portion and an aft portion forming continuations thereof, and where the bow portion has a mainly plane bottom plating, raising from the bottom of said mid-body and lacking a marked stem line, and includes a first reamer at each side wall extending downwardly rearwardly about from said deck to below the waterline, a plow-formed projection is preferably provided extending downwardly from said mid-body plane bottom, having its edge turned forwardly and located forward of the plane where said first reamers pass through said waterline and having, for a substantial part of its extension, a breadth being less than the breadth of said mid-body plane bottom and defined by a substantially plane bottom and substantially vertical side-plating.

The bottom of said aft portion preferably rises from the plane bottom of said mid-body, and above waterline shows a rear extension with reduced breadth, forming a forward and a rearward corner to each side of the deck of said aft portion. The bilges between the mid-body plane bottom and the adjoining side plating are extended towards the two forward corners, while the bilges between the plane bottom and the adjoining side plating of the plow-formed extension, extending towards the rearward corners.

DESCRIPTION OF A PREFERRED EMBODIMENT

Figure 1:
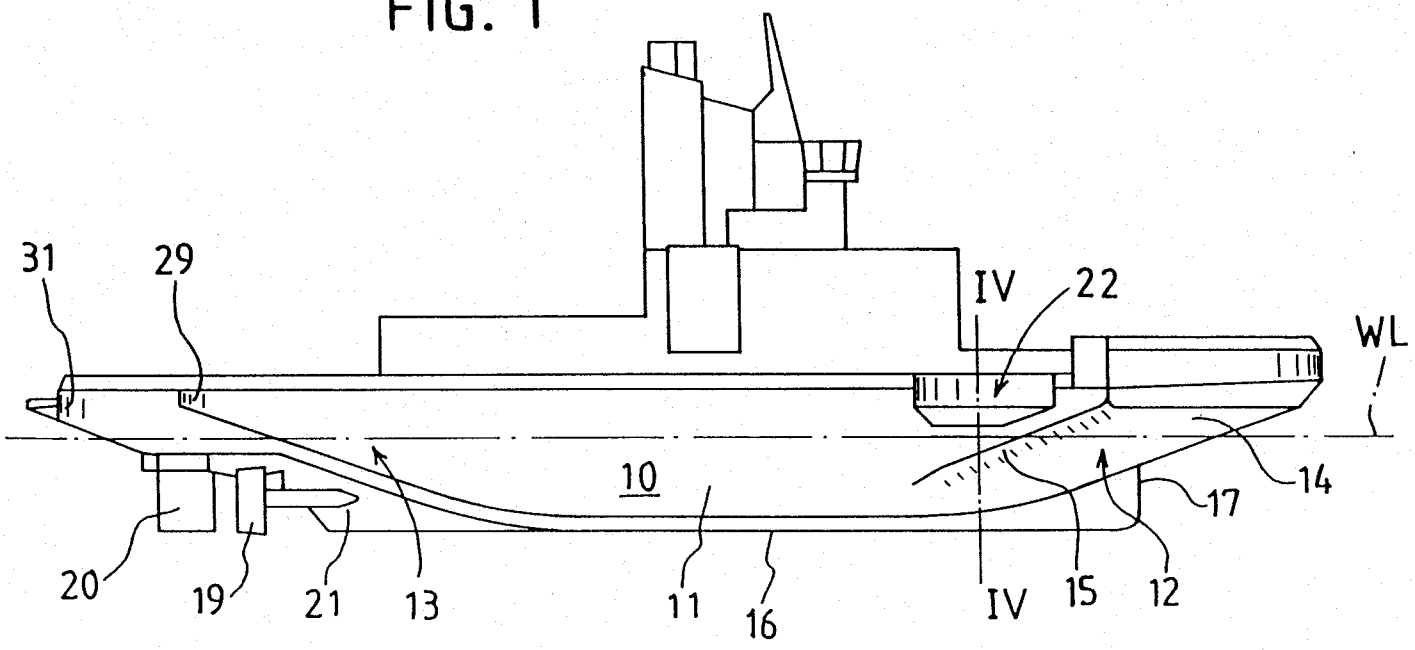
FIG. 1 shows an elevation of an ice-breaker according to the invention.

The ice-breaker shown in the drawings has a comparatively short mid-body 10, defined by mainly vertical side walls 11, a deck and a plane bottom, as well as a bow portion 12 and an aft portion 13, which both rise up above the waterline from the plane bottom.

The bow portion 12 has a plane, almost spoon-shaped bottom plating 14, lacking a marked stem line, which is advantageous with respect to the work in the ice, the ice being broken into blocks which are forced downwards, and are not split into a multitude of small floes.

The bow portion is provided with a projection 15, a so called reamer at each longitudinal side, which will determine the effective breadth of the channel opened in the ice. These reamers extend from a point above the waterline WL obliquely downwards, rearwards, about to the bottom plating of the midbody 10. The shape of these reamers 15 are best evident from FIG. 4. Their downwardly turned faces will smoothly merge into the side plating of the bow-portion, while their upwardly turned faces are plane, basically horizontal in any individual cross-section. The vertical side plating 11 continues above the reamers 15.

Figure 2:
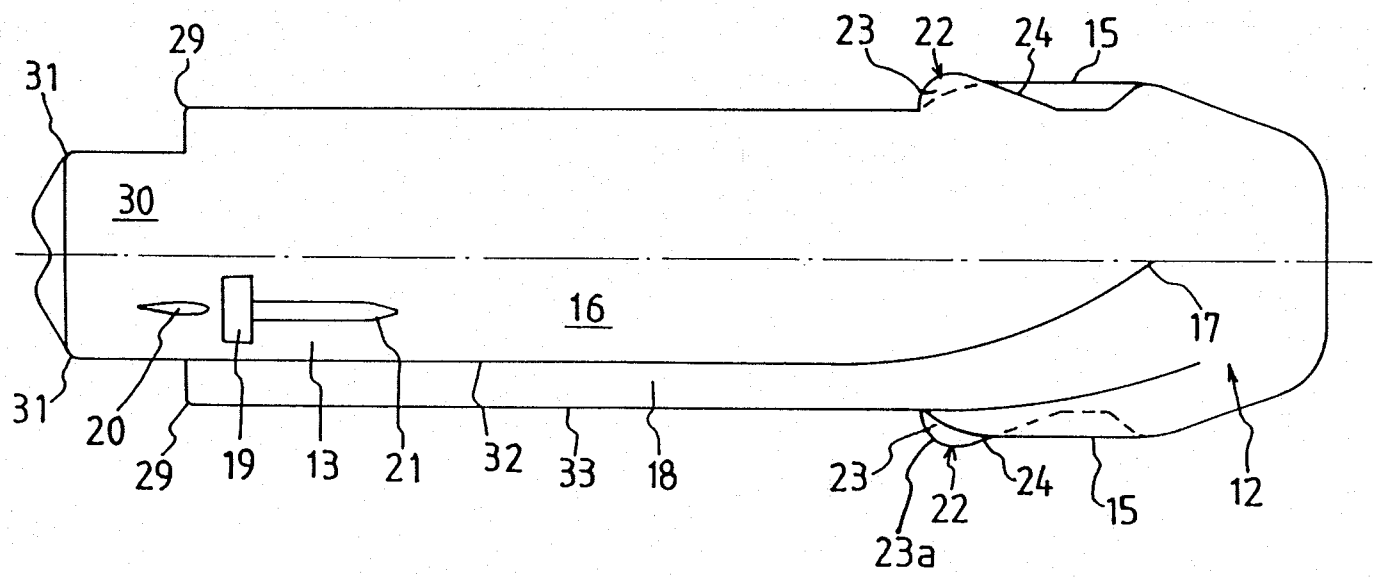
FIG. 2 shows a plan view of an ice-breaker according to FIG. 1, in which one half shows the deck and the other half shows the bottom.

The plane bottom of the vessel is provided with a downwardly directed plow-formed extension 16, the sharp forward edge 17 of which is located just forward of the above-waterline portions of the first reamers 15. The breadth of the plow-extension 16 is less than that of the plane bottom plating 18—see the lower half of FIG. 2. This form facilitates the forcing of the ice blocks broken loose by the bow portion, sidewardly, in below the margins of the channel. The vessel is provided with two nozzle-type propellers 19, and two rudders 20. The plow-extension 16 raises rearwardly to above the waterline, and the propeller shafts are carried in skegs 21 projecting from the plow-extension.

A characterizing feature of the invention is the second reamers 22, one located at each longitudinal side of the vessel, above the waterline, and substantially coinsiding with the rear portion of the adjacent first reamer 15. The top of a second reamer is substantially level with the deck of the vessel and these reamers will normally not come into contact with the ice.

A second reamer 22 shows, in a plan view, a rear portion 23 having the form of a quarter-circle 23*a* and a forward, wedge-shaped portion 24, which merges into the side plating. These two portions are outwardly defined by a vertical side-plating 25, which downwardly merges into the side plating with slanting faces 26. The latter faces cover a noticeable portion of the height of a second reamer, and will contact the ice when the vessel is being trimmed. The inclination is about 45°. A second reamer 22 will extend further out from the side plating than an adjacent first reamer 15.

Ice-breakers are conventionally provided with ballast tanks, which permit the trimming of the vessel longitudinally as well as transversely, i.a. with the object to "rock" the vessel if it should be stuck in trash-ice.

Figure 4:
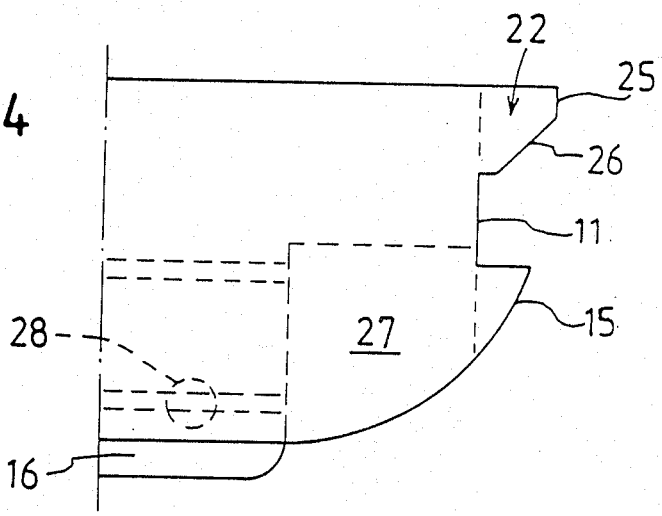
FIG. 4 shows a cross section through one half of the vessel along line IV—IV in FIG. 1.

In FIG. 4 a ballast tank 27 and pumping means 28 are shown in broken lines for reference, in order to indicate means for rapidly moving ballast water in the transverse direction.

If the vessel has been stuck in the ice it is possible by alternate trimming port and starboard to use the second reamer 22 for crushing the ice adjacent to the side plating.

Figure 3:
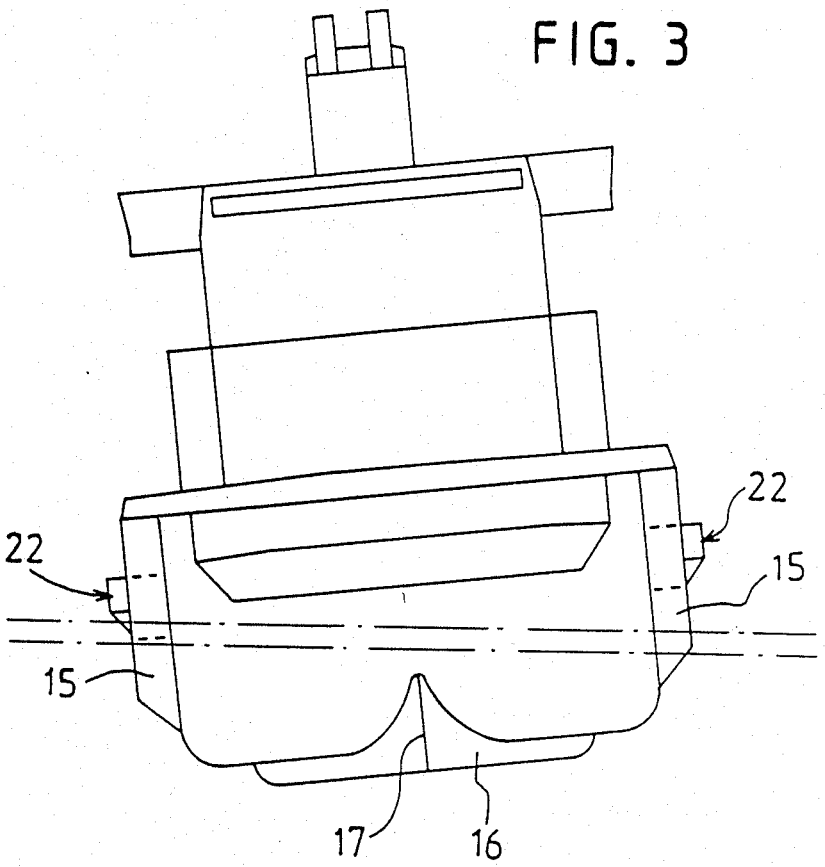
FIG. 3 shows a view of the ice-breaker, as seen from its stern, heeled over so one of the second reamers contacts the ice.

If it is desirable to perform a narrow turn it is possible, as shown in FIG. 3, to trim the vessel so one of the second reamers 22 will cut into the ice edge, and form a fulcrum for the turning movement.

Such a movement will mean that the aft body of the vessel will be brought into contact with the ice-edge at the opposite side of the channel.

In order to reduce the effective length from a second reamer 22 to the contacting corner, the aft body of the vessel has a reduced breadth over a distance from its rear edge. The plane side plating 11 terminates at forward corners 29, while the rear portion 30 of reduced breadth terminates in corners 31.

The breadth of the rear portion corresponds to the breadth of the blow extension 16, and the bilges 32 thereof are extended towards the corners 31. The bilges 33 of the plane bottom plating 18 are extended to the forward corners 29. This design permits an efficient guiding of floes during forward movement, and the portions of the bilges 32, 33 directed downwardly/forwardly from the corners 29 and 31 will push-away floes during backward movements.

The embodiment shown in the drawing is an example only of the invention, the details of which may be modified in many ways within the scope of the appended claims and depending upon the size of the vessel and its propulsive force.

We claim:

1. An ice-breaking vessel having a mid-body defined by substantially vertical side walls, a plane bottom and a deck as well as a bow portion and an aft portion forming continuations thereof said bow portion having a plane bottom extending from said plane bottom of said mid-body and lacking a marked stem line, as well as a first reamer at each side wall extending downwardly and rearwardly about from said deck to below a water-line level, a second reamer at each side wall located above said waterline level in a rear region of said first reamer at the same longitudinal side and designed with a breadth, which from a forward connection at said side wall increases rearwardly to exceed the breadth of the adjacent first reamer, said second reamer including a quarter-circular rear portion projecting from said side wall, and a forward portion extending like a wedge from said rear portion and merging into said side wall, said second reamer being sidewardly defined by an upper vertical face and a lower face tapering into said side wall, and, said vessel having transversely located trimming tanks and pumping means for transfer of ballast water between tanks with sufficient capacity to bring either of said second reamers into contact with an ice sheet at waterline level.

2. An ice-breaking vessel having a mid-body defined by substantially vertical side walls, a plane bottom and a deck as well as a bow portion and an aft portion forming continuations thereof, wherein said bow portion has a plane bottom plating extending from said plane bottom of said mid-body and lacking a marked stem line, as well as a first reamer at each side wall extending downwardly and rearwardly about from said deck to below a waterline level, a plow-formed projection extending downwardly from said midbody plane bottom, having a forward edge located forward of a plane where said first reamers pass through said waterline level and having, for a substantial part of its extension, a breadth being less than the breadth of said mid-body plane bottom and defined by a substantially plane bottom and substantially vertical side plating, and said aft portion includes a bottom portion which rises from said plane bottom of said mid-body, a rear extension with reduced breadth which forms forward and rearward corners to each side of said deck, bilges formed between said mid-body plane bottom and said side-plating extending towards said forward corners, and bilges formed between said plane bottom and said side plating extending towards said rearward corners.

* * * * *